US006088548A

United States Patent [19]

Hashimoto et al.

[11] Patent Number: 6,088,548

[45] Date of Patent: Jul. 11, 2000

[54] IMAGE FORMING APPARATUS HAVING CHARGING MEMBER WITH CONTROL OF VOLTAGE AFTER RESUMPTION OF JAM

[75] Inventors: Kouichi Hashimoto, Numazu; Atsushi Takeda, Mishima; Fumiteru Gomi, Shizuoka-ken; Yoshiyuki Komiya, Mishima, all of Japan

[73] Assignee: Canon Kabushiki Kaisha, Tokyo, Japan

[21] Appl. No.: 09/149,058

[22] Filed: Sep. 8, 1998

[30] Foreign Application Priority Data

Sep. 5, 1997 [JP] Japan ..... 9-241338

[51] Int. Cl.[7] ..... G03G 15/02

[52] U.S. Cl. ..... 399/50; 399/21

[58] Field of Search ..... 399/174, 175, 399/176, 50, 149, 150, 18, 19, 21

[56] References Cited

U.S. PATENT DOCUMENTS

| | | | |
|---|---|---|---|
| 5,371,578 | 12/1994 | Asano et al. | 399/100 |
| 5,426,489 | 6/1995 | Haneda et al. | 399/175 |
| 5,457,522 | 10/1995 | Haneda et al. | 399/176 |
| 5,606,401 | 2/1997 | Yano . | |
| 5,715,499 | 2/1998 | Yamazaki et al. | 399/50 |
| 5,754,926 | 5/1998 | Sakuraba et al. | 399/175 |
| 5,839,026 | 11/1998 | Ko | 399/100 |
| 5,842,081 | 11/1998 | Kaname et al. | 399/50 |
| 5,845,172 | 12/1998 | Saito et al. | 399/50 |

FOREIGN PATENT DOCUMENTS 0 766 146 A2 4/1997 European Pat. Off. .

*Primary Examiner*—Robert Beatty
*Attorney, Agent, or Firm*—Fitzpatrick, Cella, Harper & Scinto

[57] ABSTRACT

An image forming apparatus includes an image bearing member; a charging member, contactable to said image bearing member, for being supplied with a voltage to charge said image bearing member; a developing device for forming a toner image by developing with toner an electrostatic image formed on said image bearing member, and also being capable of cleaning said image bearing member to remove residual toner; and a transferring device for transferring the toner image onto a transfer material. When the apparatus stops during an image forming operation as during a jam, the voltage applied to said charging member is a superimposed voltage of an AC voltage and DC voltage and is a DC voltage without the AC voltage thereafter between resumption after jamming and the start of image formation.

18 Claims, 4 Drawing Sheets

IMAGE FORMING APPARATUS HAVING CHARGING MEMBER WITH CONTROL OF VOLTAGE AFTER RESUMPTION OF JAM

FIELD OF THE INVENTION AND RELATED ART

The present invention relates to an image forming apparatus comprising a charging member contactable to an image bearing member to charge the image bearing member such as a photosensitive member or a dielectric member.

In an image forming apparatus using an electrophotographic type or electrostatic recording type, a corona charger is widely used as a charging means for the image bearing member such as an electrophotographic photosensitive member or an electrostatic recording dielectric member.

On the other hand, recently, a contact charging device wherein a charging member applied with a voltage is contacted to a member to be charged to charge it, has been put into practice, and it has advantages of low ozone production, low electric power or the like. A roller type charging device using a dielectric roller is preferred because of its charging stability.

However, with such a roller charging type, the charging is effected by the discharge from the charging member to the member to be charged, and therefore, the surface potential of the photosensitive member varies depending on the change of the ambience and the variation of the electric resistances of the charging roller and the member to be charged.

Recently, a method which is less influenced by the ambient condition variation, has been proposed (for example, Japanese Patent Application No. HEI-5-66150) wherein an electroconductive contact charging member is supplied with a voltage, and electric charge is injected to trap level (contact charging). Such an injection charging type is less ambience dependence, and the required voltage may be substantially equal to the desired photosensitive member potential since the discharge is not used, and in addition, it is advantageous in that production of ozone which may reduce the lifetime of the photosensitive member, is small.

As regards the contact charging member having an electroconductivity. A charging fur brush, a charging magnetic brush or the like is usable. But, when the elasticity of the charging fur brush is deteriorated due to the long term use or long term non-use, the charging property is worsened. The charging magnetic brush does not involve such a problem so that stabilized charging continues.

The injection charging using the charging magnetic brush is understood as being equivalent to the series circuit of the resistance R and the capacitor C as shown in FIG. 3. In an ideal charging process, the capacitor C is being charged for the time period in which a certain point of the photosensitive member surface is in contact with the magnetic brush) charging nip multiplied by a peripheral speed of the photosensitive member), so that surface potential of the photosensitive member becomes substantially equal to the applied voltage. However, in an image forming apparatus wherein the toner is collected by a developing device without using a cleaner after the transfer and before the charging (cleanerless type), the toner is mixed in the magnetic brush, and the electric resistance thereof gradually increases. Therefore, the charge does not sufficiently move while passing through the charging nip, and the surface potential of the photosensitive member after the passing of the charging nip is lower than the applied voltage)the potential difference between the surface potential of the photosensitive member and the applied voltage is LDV). The decrease of the photosensitive member potential results in a toner deposition on the non-image portion in the development (so-called fog) without means for detecting the surface potential and for controlling the developing bias. When LDV is large, the magnetic particle of the magnetic brush is deposited on the photosensitive member surface, and it is discharged from the charger with the result of improper charging.

On the other hand, when the toner is given the charge of the same polarity as the photosensitive member potential by the contact between the magnetic brush and the magnetic particle, the introduced toner is ejected to the photosensitive member surface from the magnetic brush by the electric field generated by the potential difference LDV between the applied voltage and the surface potential of the photosensitive member. The difference LDV increases with the increase of the electric resistance of the magnetic brush i.e. Amount of introduced toner in the magnetic brush), and toner amount ejected increases with the increase of LDV, and therefore, if the amount of the untransferred toner does not varies significantly, the amount of introduced toner in the magnetic brush is substantially constant so that charged potential is stabilized.

It is known that LDV is dependent on the bias for the charging and that it is larger in a bias using DC only than in a bias including an AC component. EP-A-766146 discloses use of such an arrangement by which AC biased voltage is used during the image formation, and the bias of DC only is used when the toner is ejected, so that toner content in the charger is maintained low.

However, the toner collected by the injection charging device is not limited to the untransferred toner described above. The untransferred toner image occurring at the resetting operation after an enforced stop of the apparatus due to sheet jam or power failure or the like, has to be collected by the injection charging device when a non-contact type transfer charger or contact type transfer roller is used.

Also, in a belt transfer type wherein, as shown in FIG. 4, a transfer belt 25 is contacted to a photosensitive member 1 by an electroconductive brush or an electroconductive blade 26 to transfer the toner onto the transfer material carried on a belt 25, the electroconductive brush and/or the electroconductive blade 26 has to be separated until the same peripheral speeds are reached to prevent the damage of the photosensitive member 1 due to a peripheral speed difference upon the start of the rotations of the photosensitive member 1 and the transfer belt 25, and therefore, it is difficult to remove the toner by transferring the untransferred toner onto the transfer belt 25 upon the start end then removing the toner by belt cleaner.

When an ultrasonic motor or the like is used for the driving motor for the photosensitive member, the movement of the photosensitive member immediately stops in response to deactivation of the main switch, and therefore, a large amount of the toner remains on the photosensitive member. If the untransferred toner image are collected at once by the charger, the toner content in the magnetic brush abruptly increases, with the result of abrupt increase of LDV, and the abrupt lowering of the charged potential. Therefore, even if the toner is ejected from the charger using the toner discharging DC bias (DC only), the developing device cannot collect all of the ejected toner, and in addition, the fog is produced, and the fog toner is introduced again in the injection charging device. Then, the toner content in the magnetic brush is further increased. As a result, the LDV is further increased, and the fog toner amount increases.

By the repetition of the above, the resistance of the magnetic brush increases to such an extent with the result of deposition of the magnetic particles onto the photosensitive member.

SUMMARY OF THE INVENTION

Accordingly, it is a principal object of the present invention to provide an image forming apparatus wherein the development fog is effectively prevented.

It is another object of the present invention to provide an image forming apparatus wherein the movement of the toner from the charging member to the image bearing member is efficiently effected, so that decrease of the charging property of the charging member is prevented. It is a further object of the present invention to provide an image forming apparatus wherein a potential difference for moving the toner from a charging member to an image bearing member is stepwisely changed.

It is a further object of the present invention to provide an image forming apparatus wherein when a magnetic brush type charging member is used, the deposition of the magnetic particle from a charging member to an image bearing member is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Embodiment 1

Figure 1:
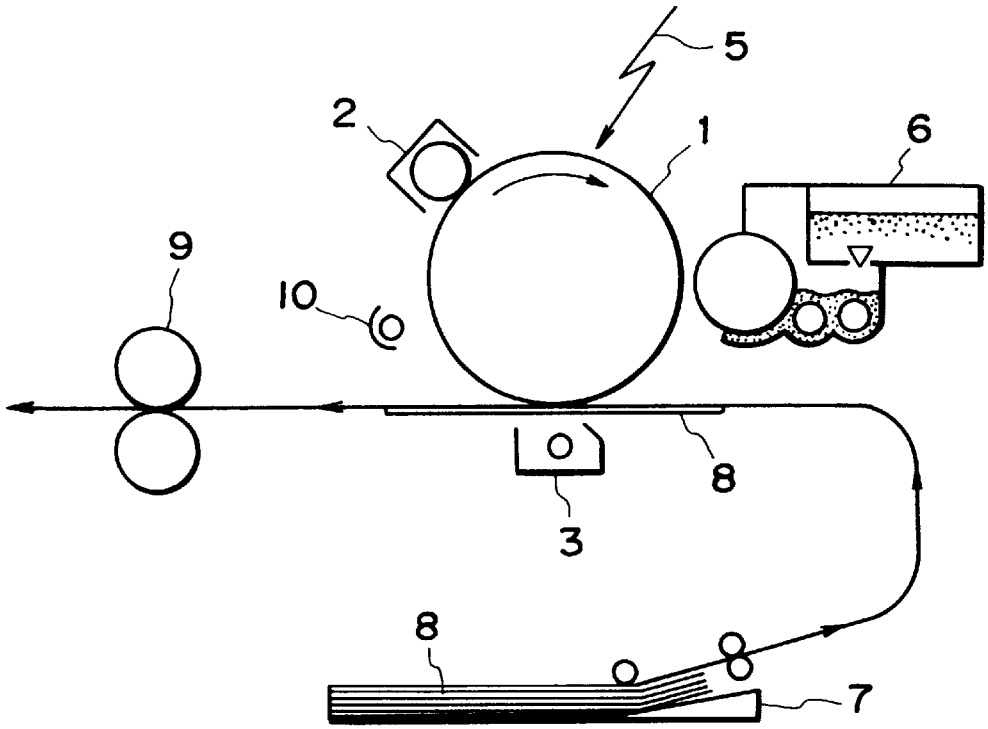
FIG. 1 is an illustration of a major part of an image forming apparatus provided with a charging device according to an embodiment of the present invention.

FIG. 1 is a schematic illustration of an image forming apparatus according to an embodiment of the present invention.

The image forming apparatus shown in FIG. 1 is provided with a photosensitive drum 1 rotatable in a direction indicated by the arrow, and around the photosensitive drum 1 there are provided a charger 2, a transfer charger 3, a developing device 6 and a pre-exposure lamp 10, and above the photosensitive drum 1, a laser beam scanner (unshown) is distributed.

The original reading apparatus including a photoelectric conversion element such as CCD outputs an image signal corresponding to monochromatic image information of an original, and a semiconductor laser contained in a laser beam scanner is controlled corresponding to an image signal to ejection a laser beam 5. An output signal from a computer can be printed.

In an entire sequence of the image forming apparatus, the photosensitive drum 1 is first uniformly charged to a negative polarity by a charger 2. The photosensitive drum 1 is rotated at a process speed (peripheral speed) of 110 mm/sec in a direction indicated by the arrow (clockwise direction).

Figure 7:
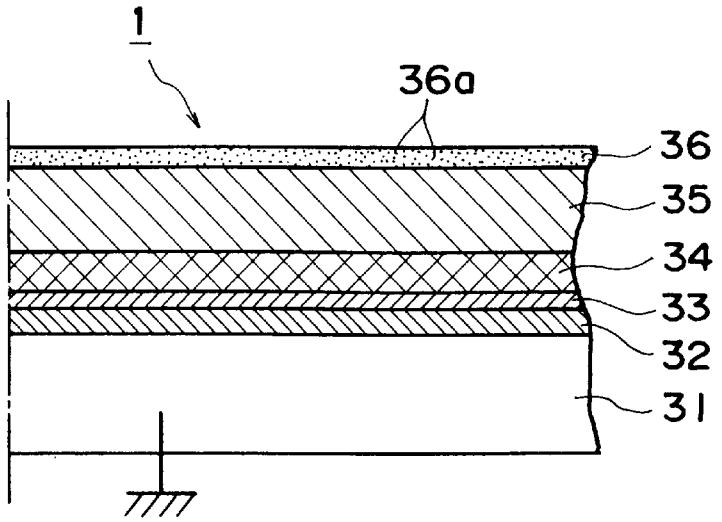
FIG. 7 is a sectional view illustrating a layer structure of a photosensitive member.

Here, the photosensitive drum 1 used in this embodiment is an OPC photosensitive member which is chargeable to the negative polarity, and as shown in FIG. 7, it includes an aluminum drum base member 31 having a diameter of 108 mm, and first—fifth layers (function layers) thereon in this order.

First layer is a primer layer 32, provided to make uniform the defects of the aluminum drum base member (aluminum base) and to prevent production of moire due to reflection of the laser exposure. It is an electroconductive layer having a thickness of approx. 20 $\mu$m.

The second layer is a positive-charge injection preventing layer 33 which functions to prevent cancellation of the negative charge of the surface of the photosensitive drum 1 by positive-charge injected from the aluminum base, and which is an intermediate resistance layer having a thickness of approx. 1 $\mu$m having a resistance adjusted to approx. $10^6$ Ωcm by AMILAN (tradename of polyamide resin material, available from Toray Kabushiki Kaisha, Japan) resin material and methoxymethyl nylon.

The third layer is a charge generating layer 34 which is a layer having a thickness of approx. 0.3 $\mu$m and including a resin material and disazo pigment dispersed therein and which generates couples of positive and negative charges upon reception of laser exposure. The fourth layer is a charge transfer layer 35 which is a P-type semiconductor comprising polycarbonate resin material and hydrazone dispersed therein. Therefore, the negative charge deposited on the surface of the photosensitive drum 1 is unable to pass through the fourth layer, and only the positive-charge generated in the charge generating layer can be moved to the surface of the photosensitive drum 1.

The fifth layer is a charge injection layer 36 in the form of a coating layer which includes light curing acrylic resin material (binder), antimony which is a light transmissive electroconductive filler (electroconductive particle) 36*a* doped to decrease the resistance (electroconductivity), and 70 percent by weight, on the basis of the resin material of ultra-fine particle of tin oxide having a particle size of 0.03 $\mu$m, dispersed therein, the layer having a thickness of approx. 3 $\mu$m. The charge injection layer preferably has such an electric resistance as has sufficient charging property and as does not form image flow, more particularly, $1\times10^{10}$–$1\times10^{14}$ Ωcm. In this embodiment, the photosensitive drum 1 has a surface resistance of $1\times10^{12}$ Ωcm.

Then, a scanning exposure operation is carried out by a laser beam 5 modulated in accordance with an image signal so that electrostatic latent image is formed on a photosensitive drum 1, and the electrostatic latent image is reverse-developed by a developing device 6 into a visualized toner image. In this embodiment, the collection property of the toner ejected from the injection charging device is improved by the use of two-component contact type developing system with a developer which is a mixture of high parting property spherical non-magnetic toner which is produced by a polymerization method and with which the amount of untransferred toner is small and a magnetic carrier. The development property in this embodiment is such that fog is produced if the difference between the charged potential and the DC component value of the developing bias is not less than 200V, and the developer carrier is deposited on the photosensitive drum 1 if it is not less than 350V, and therefore, the DC component value of the developing bias is −400V.

Figure 4:
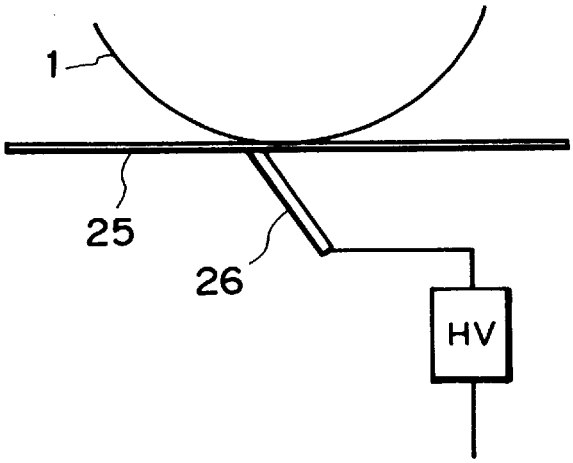
FIG. 4 shows a structure of a belt transferring device.

On the other hand, a transfer material 8 is picked out from a sheet feeding cassette 7, and is fed to a transfer portion between the photosensitive drum 1 and a transfer charger (corona charger) 3 by a sheet feeding roller along a sheet feeding guide, and the toner image formed on the photosensitive drum 1 is transferred onto the transfer material 8 by operation of the transfer charger 3. The transfer charger shown in FIG. 4 may be replaced with a combination of a charging roller or a transfer belt and an electroconductive brush, an electroconductive blade, an electroconductive roller press-contacted to a back side thereof (contact type transfer charger). The toner remaining on the surface of the photosensitive drum 1 without being transferred, is temporarily collected into the charger 2. The surface potential of the photosensitive drum 1 is discharged to approx. 0V immediately before the charging operation by a pre-exposure lamp 10 disposed between the transfer charger 3 and the charger 2.

The foregoing description has been made with respect to a monochromatic image formation. The photosensitive member, the charger, the developing device and the exposure device may be provided for yellow, magenta, cyan and black colors, and the toner image of the photosensitive members are sequentially transferred onto a transfer material carried on a transfer material holding member in the form of a belt or a drum, so that full-color image can be provided.

The transfer material having the transferred toner image 8 is fed by a conveyor belt to a fixing device (heat roller fixing device) 9 where the toner image is fixed.

The residual toner on the photosensitive member after image transfer is collected into the charger 2. In order to improve the collection property of the toner into the charger 2, it is preferable to contact to the photosensitive member 1 an auxiliary member of fiber brush supplied with a positive voltage upstream of the charger 2 and downstream of the transfer charger 3 with respect to a rotational direction of the photosensitive member. By the auxiliary member, the polarity of the residual toner is all made uniform to the positive charging, so that it becomes easy for the residual toner to be collected to the charger 2 supplied with a negative voltage. The toner once collected to the charger 2 is charged to the negative polarity by triboelectric charge with the magnetic particles of the charger 2, and is ejected to the photosensitive member 1 for the charger 2 by the potential difference LDV between the surface potential of the photosensitive member 1 charged by the charger 2 and the DC voltage applied to the charger 2. By the ejection of the toner to the photosensitive member after the collection to the charger 2, the previous image pattern is prevented from remaining in the image formation in an image forming apparatus wherein the developing device effects the developing operation and the cleaning operation simultaneously.

Simultaneously with the ejection of the negative charged toner from the charger 2 to the photosensitive member 1, the photosensitive member 1 is charged to the negative polarity. Thereafter, the photosensitive member 1 having the toner remaining thereon is exposed to the image laser beam 5 so that electrostatic latent image is formed on the photosensitive member 1. The developing device 6 has a developer carrying member in the form of a sleeve. The developing sleeve is applied with a developing bias voltage between the dark portion potential and the light portion potential of the electrostatic latent image, and simultaneously with formation of an electric field for depositing the toner to the light portion of the photosensitive member from the developing sleeve, an electric field for collecting the toner to the developing sleeve from the dark portion of the photosensitive member, is formed. In other words, the developing device 6 effects the simultaneous developing operation and cleaning operation for cleaning the photosensitive member by removing the residual toner. If the residual toner amount on the photosensitive member is too large during the development, the toner is not sufficiently collected by the developing device with the result of fog toner remaining on the photosensitive member.

Figure 2:
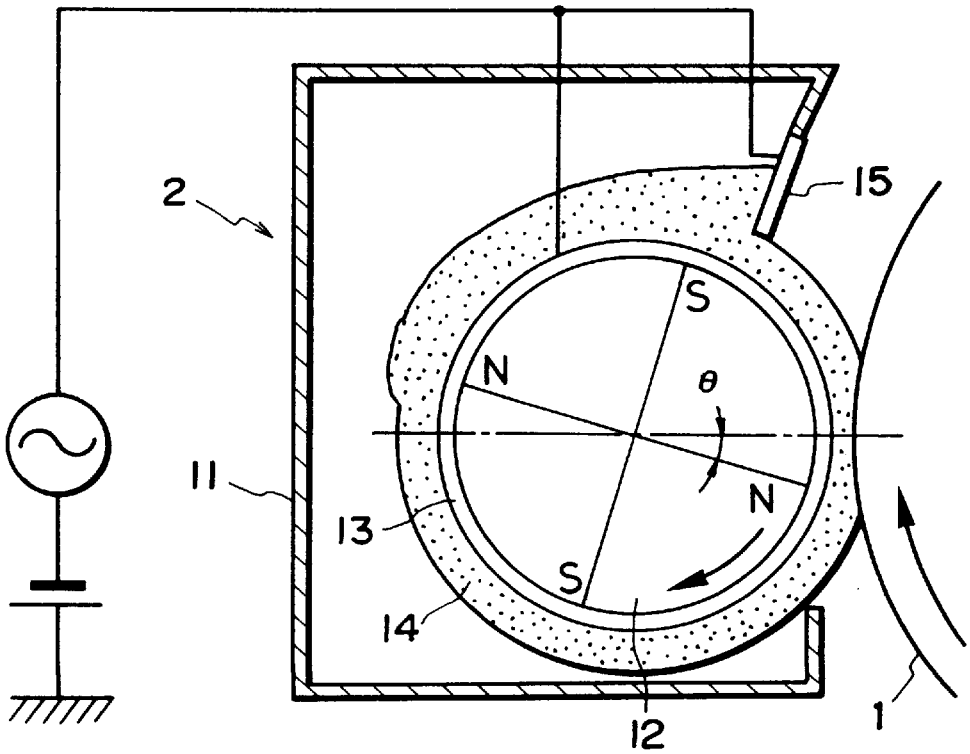
FIG. 2 is an illustration of a charging device according to an embodiment of the present invention.
Figure 3:
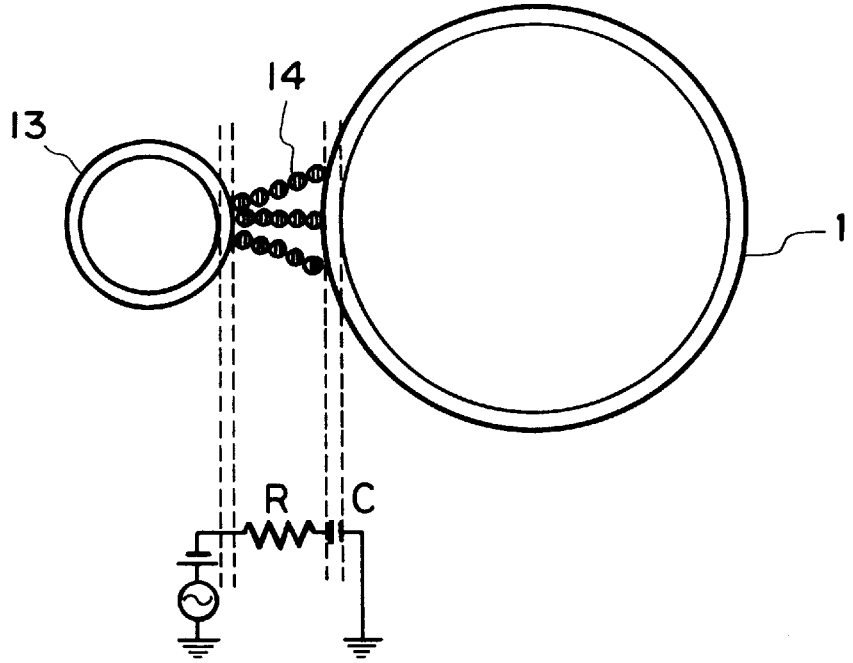
FIG. 3 shows an equivalent circuit of injection charging.

Referring to FIG. 2, the description will be made as to the charger 2. FIG. 2 is a sectional view of the charger 2.

The container 11 comprises a sleeve 13 of non-magnetic material, a fixed magnet 12 therein, magnetic particles 14 for injecting the charge by contact to the photosensitive drum 1, a regulating blade 15 for coating the surface of the sleeve 13 with the magnetic particles 14 into a uniform thickness. The sleeve 12 of non-magnetic stainless steel is rotated at a peripheral speed of 165 mm/sec in the same direction (clockwise direction) as the photosensitive drum 1. More particularly, the peripheral movement of the sleeve 12 and that of the drum 1 are opposite at the charging nip. The regulating blade 15 of non-magnetic stainless steel is disposed with a gap of 900 $\mu$m from the surface of the sleeve 13.

The stationary magnet in the sleeve 13 has a magnetic pole (main pole) of approx. 900G at a position of 10° from the closest position between the photosensitive drum 1 and the sleeve 13 toward an upstream side of the rotational direction of the photosensitive drum. The main pole is preferably disposed in the range between 20° upstream from the closest position and 10° downstream therefrom (0 in the FIGURE) with respect to the rotational direction of the photosensitive drum, and further preferably 15°–0° upstream therefrom). If the position is more downstream, the magnetic particles 14 are attracted to the main pole position, so that magnetic particles 14 tend to stagnate downstream of the charging nip with respect to the rotational direction of the photosensitive drum, and if it is more upstream, the feeding performance of the magnetic particles 14 after the charging nip is worsened, so that stagnation tends to occur. If the magnetic pole is not provided in the charging nip, the confining force acting on the magnetic particles 14 toward the sleeve 13 is weak with the result of the tendency of the magnetic particles 14 being deposited onto the photosensitive drum 1. Here, the charging nip is the region where the magnetic particle 14 is contacted to the photosensitive drum 1 during the charging.

When a region of the photosensitive drum 1 which is going to be an image region is in the charging nip, the charging bias in the form of an AC biased DC voltage is applied to the sleeve 13 and to the regulating blade 15. The DC voltage is the same as the required surface potential of the photosensitive drum 1 (−700V in this embodiment). The peak-to-peak voltage of the AC component (Vpp) is preferably $100V \leqq Vpp \leqq 2000V$, and further preferably, $300V \leqq Vpp \leqq 1200V$. If Vpp is lower than that, advantageous effects in the uniform charging property and the rising of the potential, is not so high, and if it is larger than that, the stagnation of the magnetic particles 14 and the deposition thereof on the photosensitive drum 1 are worsened. The frequency is preferably not less than 100 Hz and not more than 5000 Hz, more preferably not less than 500 Hz and not more than 2000 Hz. If it is lower than that, the deposition of the magnetic particles 14 on the photosensitive drum 1 is worsened, and the advantageous improvement of the rising of the potential and the uniform charging property is not so high. If it is larger than that, the advantageous improvement of the rising of the potential and the uniform charging property is not so high, either. The waveform of the AC component may be a rectangular wave, a triangular wave, a sin wave or the like.

In this embodiment, the magnetic particles 14 are produced by deoxidization process of sintered ferromagnetic member (ferrite), but this is not limiting, and they may be produced by kneading the ferromagnetic powder and another resin material and forming it to particles, or by mixing electroconductive carbon in them or by surface treatment of them to adjust the resistance. The magnetic particle 14 has a function of injecting properly the charge to the trap level of the surface of the photosensitive drum 1 and a function of preventing the power supply failure to the charging member and the photosensitive drum 1 which may occur due to concentration of the charging current as a result of a drawback such as a pin hole in the photosensitive drum 1. To accomplish this, the resistance value of the charging member is preferably $1\times10^4$ Ω–$1\times10^9$ Ω and further preferably $1\times10^4$Ω–$1\times10^7$ Ω. If the resistance value of the charging member is less than $1\times10^4$ Ω, the pin hole leakage tends to occur, and if it exceeds $1\times10^9$ Ω, charge is not good. In order to control the resistance value in the range, the volume resistivity of the magnetic particle 14 is preferably $1\times10^4$ Ωcm–$1\times10^9$ Ωcm, and further preferably $1\times10^4$ Ωcm–$1\times10^7$ Ωcm.

Figure 5:
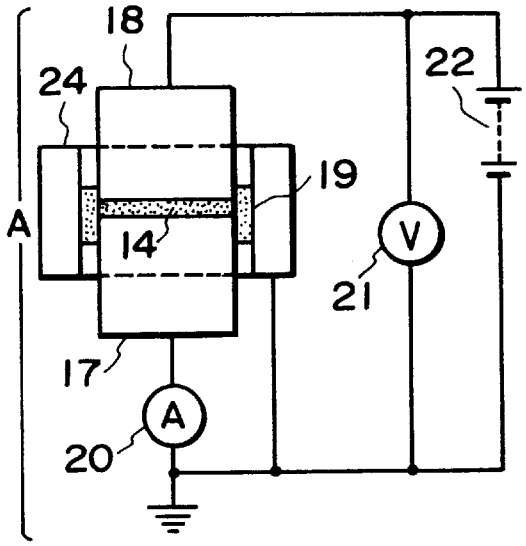
FIG. 5 shows a measuring method of an electric resistance of magnetic particles.

The volume resistivity of the magnetic particles 14 was measured using a cell A shown in FIG. 5. The magnetic particles 14 are filled in the cell A, and electrodes 17 and 18 are contacted to the magnetic particles 14. A voltage is applied between the electrodes 17, 18, and the current is measured, and then the volume resistivity of the magnetic particles 14 are calculated. The measurement conditions are as follows: the temperature of 23° C. the humidity of 65%, the contact area S=2 $cm^2$, the thickness d=1 mm, the load to the upper electrode 18 of 10 kg, and the applied voltage of 100V. In FIG. 5, designated by 17 is a main electrode; 18 is an upper electrode; 19 is an insulative material; 20 is an ammeter; 21 is a voltmeter; 22 is a constant voltage means; and 24 is a guide ring.

The average particle size and the peak of the magnetic particles 14 determined by the particle size distribution measurement are preferably in the range of 5–100 μm from the standpoint of prevention of deterioration of charging due to the contamination of the surfaces of the particles.

The resistance value of the charging member used in this embodiment is $1\times10^6$ Ωcm, and by the application of −700V as the DC component of the charging bias, the surface potential of the photosensitive drum 1 is charged to −700V.

Figure 6:
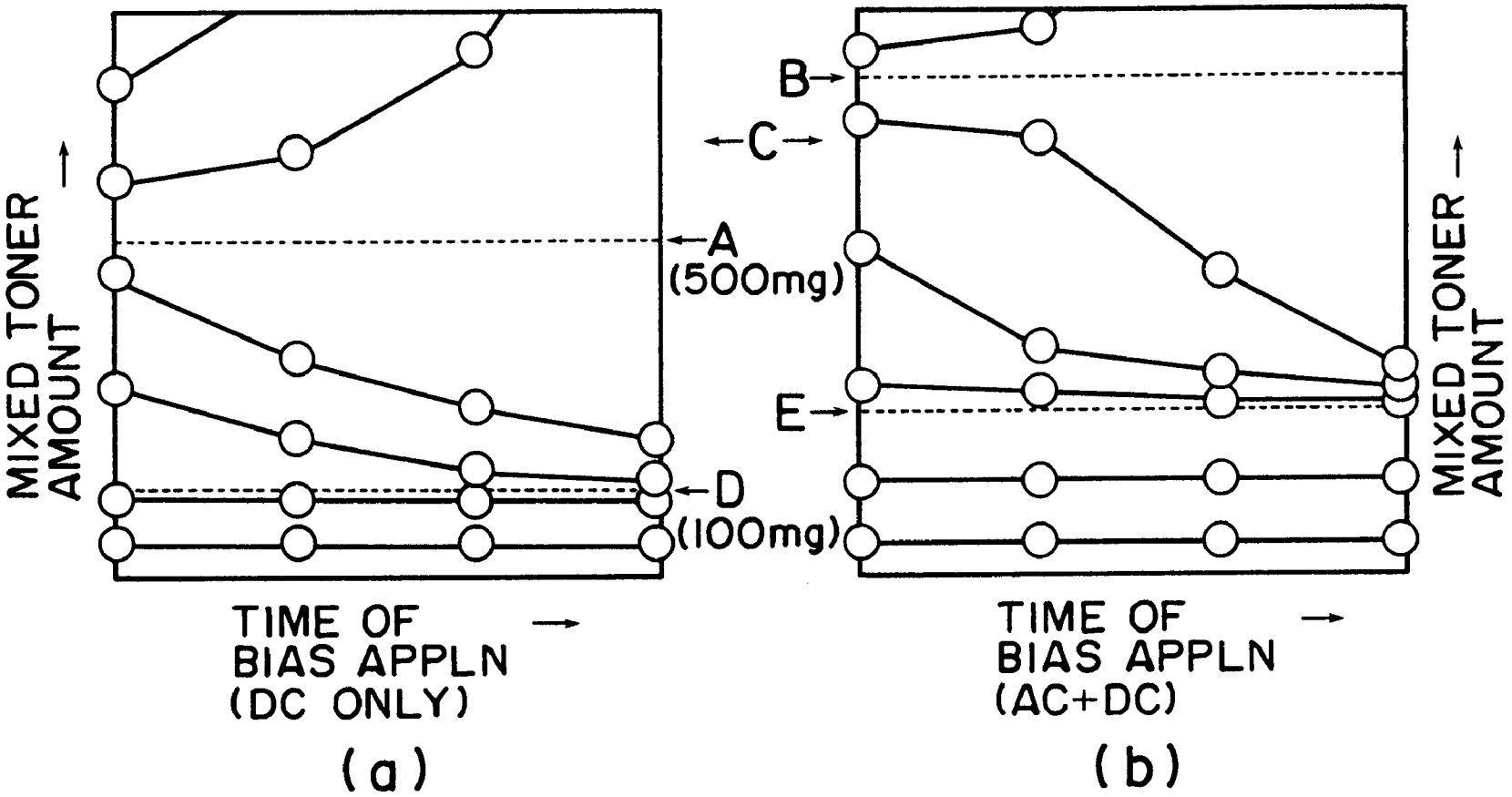
FIG. 6 illustrates a change of a toner content resulting from toner discharge from an injection charging device.

With the foregoing structures, the experiments have been carried out as follows. Different amounts of the toner are mixed beforehand in the magnetic particles 14 of the charger. The amount of introduced toner in the magnetic particles 14 are measured when the toner is ejected to the drum from the charger for the case of the voltage having a DC component only applied to the sleeve 13 and for the case of the voltage having the AC and DC components applied thereto. To measure the amount of introduced toner, Ct(g) of the magnetic particles is placed in a plastic resin material container having a weight Cp(g), and a magnet is contacted to the bottom side or the container to confine the magnetic particle to the bottom, and in this state, only the toner is washed out with water containing a surfactant. Then the magnetic particles are dried with the container, and the amount of introduced toner (g) is determined using a total weight Cc(g) of the container and the remaining magnetic particle, that is, the amount of the mixed toner =Cp+Ct−Cc. FIG. 6 shows the results.

FIG. 6, (a) shows the results when the bias voltage having a DC component only is applied to the sleeve 13, wherein the amount of introduced toner and LDV hardly changes when the amount of introduced toner is not more than 100 mg. When a slightly larger amount of the toner is contained, the amount of introduced toner approaches to 100 mg because of the ejection function provided by the DC bias. Therefore, the discharge toner amount limit D is understood as being 100 mg. When the initial amount of introduced toner is not less than 500 mg, the amount of introduced toner increases with elapse of time. This is because if the amount of the introduced toner is too large, LDV becomes large and discharges such a large amount of the toner to the photosensitive member which cannot be collected by the developing station with the result of fog production, and therefore, the fog toner is introduced in the charger, which introduction again increase LDV. When the amount of introduced toner is at a certain level, the ejected toner amount and the fog toner amount are balanced, so that amount of toner is constant. Such an amount of toner is called toner content limit amount (in the FIG. A).

On the other hand, FIG. 6, (b) shows the result when the sleeve 13 is supplied with a voltage in the form of an AC biased DC. In this case, the charging property is good, and the potential difference LDV between the surface potential of the photosensitive drum and the applied bias is small, so that ejection toner amount limit E and the toner content limit amount (in the FIG. B) are larger than in the case of the DC bias voltage. Therefore, in FIG. 6, when the amount of introduced toner is between A and B, the fog can be prevented, and the ejected toner can be collected by ejecting the toner by the AC plus DC voltage and then ejecting the toner by the DC voltage (without AC). The mixing limit amount of the toner which can be discharged can be reduced and the limit amount of the toner which can be discharged are reduced, by first applying to the sleeve the AC plus DC voltage and then DC bias (without thereafter AC) voltage.

The maximum value of the untransferred toner amount on the photosensitive drum surface at the time of the sheet jam or power failure is approx. 120 mg (the sheet jam between the registration roller and the transfer charger or the power failure when the sheet is therebetween). In view of this, 500 mg of the toner has been mixed in the charging magnetic particle beforehand, and the fog toner has been checked while changing the application period of the AC+DC bias voltage. Table 1 shows the results, wherein it will be understood that fog does not occur if the AC+DC bias voltage is applied for not less than 15 sec, and thereafter, DC bias voltage (without AC) is applied. However, if the former period (AC plus DC application) is shorter than 15 sec, the latitude of the developing bias voltage to be applied to the developing sleeve is quite small as compared with the case of not less than 15 sec, even though the fog is quite small. The fog is produced if no AC plus DC bias voltage is applied at all, and the DC without AC is applied from the beginning.

TABLE 1

| AC biased voltage Application period (sac) | 0 | 5 | 10 | 15 | 20 | 25 |
|---|---|---|---|---|---|---|
| Fog production | N | F | F | G | G | G |

N: foggy
F: no fog (small developing bias latitude)
G: no fog (large developing bias latitude)

Therefore, when the image forming apparatus is stopped due to the jam or power failure while the image formation is being carried out, the charging sleeve 13, after the main switch is activated again and before the stand-by state wherein the image forming operation is startable is established, is first supplied with an AC plus DC bias voltage to decrease the LDV, and then the DC without AC is applied to increase the LDV.

If the jam occurrence is detected before completion of the image forming operation, the voltage source is shut off, and the operator opens the front door to clear the jam. Then, the operator close the door, and then the apparatus is restarted.

It is an usable alternative that for each normal main switch actuation, the charging sleeve 13 is supplied with the AC plus DC voltage and then with DC (without AC) voltage between the activation of the power source and the stand-by state.

By the above-described toner discharge sequence for discharging the toner from the charger 2 to the photosensitive drum 1, the toner ejection can be carried out efficiently without occurrence of toner fog in the development and without sticking of the magnetic particles from the charger to the drum.

Embodiment 2

In Embodiment 1, the bias is switched from AC plus DC to DC only, but in this embodiment, the Vpp of the AC component of the applied bias voltage is gradually decreased to accomplish the toner discharge without fog.

When the image forming apparatus is stopped due to jam or power failure during the image formation operation, the peak-to-peak voltage of the AC component of the AC plus DC voltage applied to the charging sleeve 13 is attenuated gradually between the reactivation of the power source and the establishment of the stand-by state.

Table 2 shows the relation between the attenuation speed of the peak-to-peak voltage Vpp (V/sec) and the fog production by the development.

The attenuation speed of the Vpp of the AC component was changed to 20, 30, 40, 50, 60, 70V/sec. As will be understood from Table 2, the latitude of the developing bias is larger in 20–50V/sec, and therefore, ejection does not produce the fog, but when it is higher than that, the latitude of the developing bias is smaller when the fog resulting from the ejected toner is prevented.

TABLE 2

| Vpp attenuation speed (V/sec) | 20 | 30 | 40 | 50 | 60 | 70 |
|---|---|---|---|---|---|---|
| Fog | G | G | G | G | F | F |

F: no fog (small latitude of developing bias)
G: no fog (large latitude of developing bias)

Embodiment 3

Figure 8:
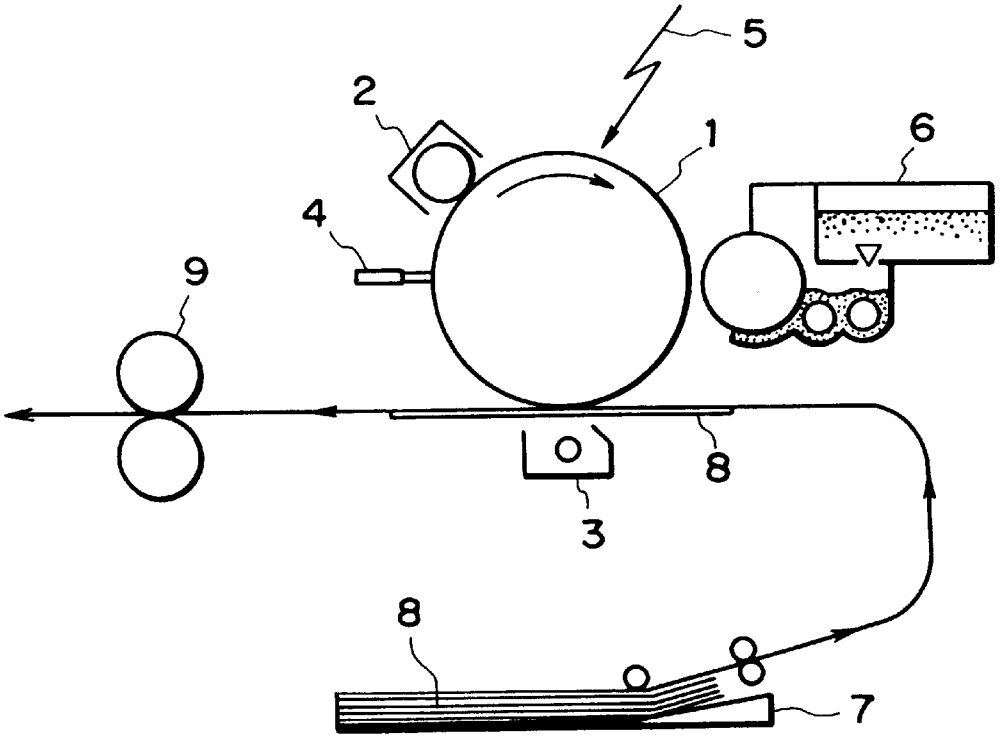
FIG. 8 is an illustration of an image forming apparatus according to a third embodiment of the present invention.

In this embodiment, as shown in FIG. 8, an auxiliary member in the form of a fixed brush 4 is contacted to the photosensitive drum surface in place of the pre-exposure device between the transfer position and the charging position in Embodiment 1, and a voltage of the opposite polarity from the charge polarity of the charger is applied, by which the potential of the photosensitive drum is discharged to approx. 0V. By this, effect equivalent to Embodiment 1 was provided. In place of the fixed brush 4, a corona charger or the like is usable to discharge the photosensitive drum to approx. 0V, and the similar effects can be provided.

The fixed brush 4 may be additionally supplied with an AC voltage in addition to the voltage, and it may be applied with a photosensitive drum voltage without DC voltage.

Embodiment 4

In this embodiment, the exposure device disposed between the transfer position and the charging position in Embodiment 1 is omitted, and the potential of the photosensitive drum is discharged to approx. 0V by the transfer charger supplied with the positive voltage during the toner discharging operation from the charger to the drum. By making the drum potential 0V, the toner discharge effect is improved as compared with the case of the negative drum potential.

In all of the foregoing embodiments, when the apparatus stops without completion of the image formation, it is desirable to provide an adjusting apparatus for changing the time duration in which the superimposed voltage of the AC voltage and the DC voltage is applied to the charger after the reactivation of the electric power and before the establishment of the stand-by state, in accordance with the state of the stop of the apparatus. More particularly, the time duration of the superimposed voltage application is preferably longer if the amount of the untransferred toner on the image bearing member at the time of the stop of the apparatus is larger.

For example, when the jam occurs at the position of the fixing device, the apparatus is preferably stopped immediately, so that amount of the untransferred toner is large. When the jam occurs at the sheet feeding station, and the transfer material is at the transfer position, the toner image preferably is transferred onto the transfer material which is at the transfer position, and then the transfer material is discharged out, by which the amount of the untransferred toner can be reduced. Therefore, the time duration of the application of the superimposed voltage is changed in accordance with the jam occurrence position.

Furthermore, it is preferable that time duration of the superimposed voltage application is made longer when the image ratio at the time of the stop of the apparatus without completion of the image formation, is larger, since then the cleaning efficiency is improved. The image ratio can be determined on the basis of the image signal (video signal).

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

a charging member, contactable to said image bearing member, for being supplied with a voltage to charge said image bearing member;

developing means for forming a toner image by developing with toner an electrostatic image formed on said image bearing member, using charging by said charging member, said developing means being capable of cleaning said image bearing member to remove residual toner; and transferring means for transferring the toner image onto a transfer material, wherein the voltage applied to said charging member is a superimposed voltage of an AC and DC voltage and is a DC voltage without the AC voltage thereafter, between resumption after jamming and an image forming operation.

2. An apparatus according to claim 1, wherein a region of said image bearing member which is going to be an image region is at a charging position where said image bearing member is charged by said charging member, said charging member is supplied with the superimposed voltage.

3. An apparatus according to claim 1, further comprising an auxiliary member for charging the residual toner to a polarity opposite from a charge polarity of said charging member, said auxiliary member being disposed downstream of a transfer position where the toner image is transferred onto a transfer material and upstream of a position where said image bearing member is charged by said charging member with respect to a movement direction of a surface of said image bearing member.

4. An apparatus according to claim 1, further comprising a fiber brush applied with a voltage of a polarity opposite from a charge polarity of said charging member, said auxiliary member being disposed downstream of a transfer position where the toner image is transferred onto a transfer material and upstream of a position where said image bearing member is charged by said charging member with respect to a movement direction of a surface of said image bearing member.

5. An apparatus according to claim 1, wherein a time duration in which said superimposed voltage is applied to said charging member is changed in accordance with a jam occurrence position of a transfer material when said apparatus stops.

6. An apparatus according to claim 1, wherein a time duration in which said superimposed voltage is applied to said charging member is changed in accordance with an image ratio when said apparatus stops.

7. An apparatus according to claim 1, wherein said charging member is provided with a magnetic brush of magnetic particles contactable to said image bearing member.

8. An apparatus according to any one of claims 1–7, wherein said charging member effects injection charging of said image bearing member at a contact portion between said charging member and said image bearing member.

9. An apparatus according to any one of claims 1–7, wherein said image bearing member is provided with a surface layer having a volume resistivity of $1\times10^{10}$–$1\times10^{14}$ Ωcm.

10. An apparatus according to claim 9, wherein said image bearing member has an electrophotographic photosensitive layer inside said surface layer.

11. An image forming apparatus comprising:

an image bearing member;

a charging member, contactable to said image bearing member, for being supplied with a voltage to charge said image bearing member;

developing means for forming a toner image by developing with toner an electrostatic image formed on said image bearing member, using charging by said charging member, said developing means being capable of cleaning said image bearing member to remove residual toner; and transferring means for transferring the toner image onto a transfer material, wherein the voltage applied to said charging member is a superimposed voltage of an AC voltage component and a DC voltage component and the AC voltage component is decreased thereafter, between resumption after jamming and an image forming operation.

12. An apparatus according to claim 11, wherein a region of said image bearing member which is going to be an image region is at a charging position where said image bearing member is charged by said charging member, said charging member is supplied with the superimposed voltage.

13. An apparatus according to claim 11, further comprising an auxiliary member for charging the residual toner to a polarity opposite from a charge polarity of said charging member, said auxiliary member being disposed downstream of a transfer position where the toner image is transferred onto a transfer material and upstream of a position where said image bearing member is charged by said charging member with respect to a movement direction of a surface of said image bearing member.

14. An apparatus according to claim 11, further comprising a fiber brush applied with a voltage of a polarity opposite from a charge polarity of said charging member, said auxiliary member being disposed downstream of a transfer position where the toner image is transferred onto a transfer material and upstream of a position where said image bearing member is charged by said charging member with respect to a movement direction of a surface of said image bearing member.

15. An apparatus according to claim 11, wherein said charging member is provided with a magnetic brush of magnetic particles contactable to said image bearing member.

16. An apparatus according to any one of claims 11–15, wherein said charging member effects injection charging of said image bearing member at a contact portion between said charging member and said image bearing member.

17. An apparatus according to any one of claims 11–15, wherein said image bearing member is provided with a surface layer having a volume resistivity of $1\times10^{10}$–$1\times10^{14}$ Ωcm.

18. An apparatus according to claim 17, wherein said image bearing member has an electrophotographic photosensitive layer inside said surface layer.

* * * * *

UNITED STATES PATENT AND TRADEMARK OFFICE

CERTIFICATE OF CORRECTION

PATENT NO. : 6,088,548
DATED : July 11, 2000
INVENTOR(S) : Kouichi Hashimoto, et al.

It is certified that error appears in the above-identified patent and that said Letters Patent is hereby corrected as shown below:

Column 1,
Line 35, "dependence" should read -- dependent --;
Line 41, "troconductivity. A" should read -- troconductivity, a --;
Line 53, "brush)" should read -- brush --;
Line 54, "charging" should read -- (charging --; and
Line 65, "voltage) the" should read -- voltage (the --.

Column 4,
Line 4, "ejection" should read -- eject --.

Column 9,
Line 4, in Table 1, "(Sae)" should read -- (see) --; and
Line 21, "close" should read -- closer --.

Column 11,
Line 7, "AC and DC voltage" should read -- AC voltage --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*